US005353547A

United States Patent [19]

Foster

[11] Patent Number: 5,353,547

[45] Date of Patent: Oct. 11, 1994

[54] WATER ACTIVATED HATCH CLOSURE

[76] Inventor: Colin Foster, 910 Mullet Rd., Cape Canaveral, Fla. 32920

[21] Appl. No.: 99,317

[22] Filed: Jul. 30, 1993

[51] Int. Cl.[5] ..... E05F 15/20

[52] U.S. Cl. ..... 49/22

[58] Field of Search ..... 49/21, 22; 114/118; 160/5; 292/339, DIG. 19

[56] References Cited

U.S. PATENT DOCUMENTS

| | | | |
|---|---|---|---|
| 904,304 | 11/1908 | Bulger | 292/339 X |
| 908,020 | 12/1908 | MacVicar et al. . | |
| 1,094,862 | 4/1914 | Newcomb | 292/339 |
| 1,604,289 | 4/1926 | Kindler et al. . | |
| 1,752,854 | 6/1929 | Schierghofer . | |
| 2,441,230 | 10/1944 | Stukes . | |
| 2,507,318 | 5/1950 | Mumenthaler . | |
| 3,005,488 | 10/1961 | Murphy et al. . | |
| 3,104,870 | 7/1961 | Kawabata . | |

*Primary Examiner*—Peter M. Cuomo
*Assistant Examiner*—Jerry Redman
*Attorney, Agent, or Firm*—Hoffman, Wasson & Gitler

[57] ABSTRACT

A closure assembly and strut for a pivoting closure which automatically operates to close the closure when rain begins to fall. The closure assembly is provided with two pivoting arms which, when pivoted to their extreme positions, would allow a slot provided on a hinge portion of each arm to align into which a soluble restraining element is placed. The extremity portions of each arm are used to support the closure in an opened position. When it begins to rain, water would hit the soluble element directly or would indirectly be directed to this soluble element through capillary action which would soften the soluble restraining element, allowing a spring to trip the pivot out of alignment with the ends, thereby precipitating the collapse of the closure element. Once the closure element collapses, the closure would close due to the force of gravity.

16 Claims, 3 Drawing Sheets

WATER ACTIVATED HATCH CLOSURE

BACKGROUND OF THE INVENTION

1. Field of the Invention

The present invention generally pertains to a rain or water activated closure utilized to close a window, door or similar device with the assistance of gravity during a rainstorm or similar event. More particularly, the invention relates to deck hatches provided on the deck surface of a boat for the purpose of providing ventilation to the cabin areas below deck and for allowing access to the top side of the deck area from a below-deck location.

It is desirable to provide deck-mounted hatches on marine vessels, such as pleasure boats and fishing boats, in order to achieve cabin ventilation to produce an acceptably wholesome atmosphere below deck. These hatches are typically square, with a hinge on one side and a mechanism on the opposite side to hold the hatch in an opened or closed position. Since the hatch cover could be opened for a long period of time while the boat rides at anchor, without the boat being occupied, it is important to ensure that the hatch would automatically be closed during a rainstorm. The present invention addresses this problem by providing a moisture sensing device which would automatically and quickly close the hatch if it begins to rain.

2. Description of the Prior Art

The prior art is replete with devices which would automatically close a window in the event of rain. These patents include U.S. Pat. Nos. 908,020, issued to MacVicar et al.; 1,604,289, issued to Kindler et al.; 1,752,854, issued to Schierghofer; 2,441,230, issued to Stukes; 2,507,318, issued to Mumenthaler; and 3,104,870, issued to Kawabata. Typically, these patents describe devices containing a soluble restraining element for maintaining a sliding window in the opened position. When this soluble restraining element, such as blotting paper or an effervescent salt becomes saturated, a mechanism would trip, allowing the window to slide closed by the action of a closure member and/or gravity. However, none of these references describe a window closure mechanism in which the soluble restraining element is used to close a pivotally closing member, such as a ship's hatch.

SUMMARY OF THE INVENTION

The present invention is designed to address the deficiencies of the prior art references by providing a collapsible strut or closure which is placed under the opening edge of the hatch of a ship and temporarily replaces the normal mechanism provided to hold the hatch open, or can be used in conjunction with such a hatch opening retaining mechanism. The strut is constructed from two arms with a pivot allowing it to bend. A slot which intersects the arms of the strut near the pivot is provided such that, when a soluble restraining element, such as an uncoated aspirin is inserted in the slot, the strut is locked in a straight, or uncollapsed position. The pivot and the two arms of the strut are designed so that when it is in the opened position such that it supports the hatch in the opened position, the pivot and the two arms are in a straight line and no stress from the weight of the hatch is transmitted to the soluble restraining element provided in the slot. A spring, or other tensioning device, such as a rubber band, is attached to the two arms of the strut to provide a controlled and constant collapsing force on the soluble restraining element, independent of the weight of the hatch. The extremities of the arms of the strut are constructed to fit over the edges of the raised hatch or the hatch frame, so that the weight of the hatch, resting on the strut, holds it in place.

These, and other salient objects and features of the invention will become more apparent to those skilled in the art in view of the following description, taken in conjunction with the accompanying drawings.

DESCRIPTION OF THE PREFERRED EMBODIMENT

Figure 1:
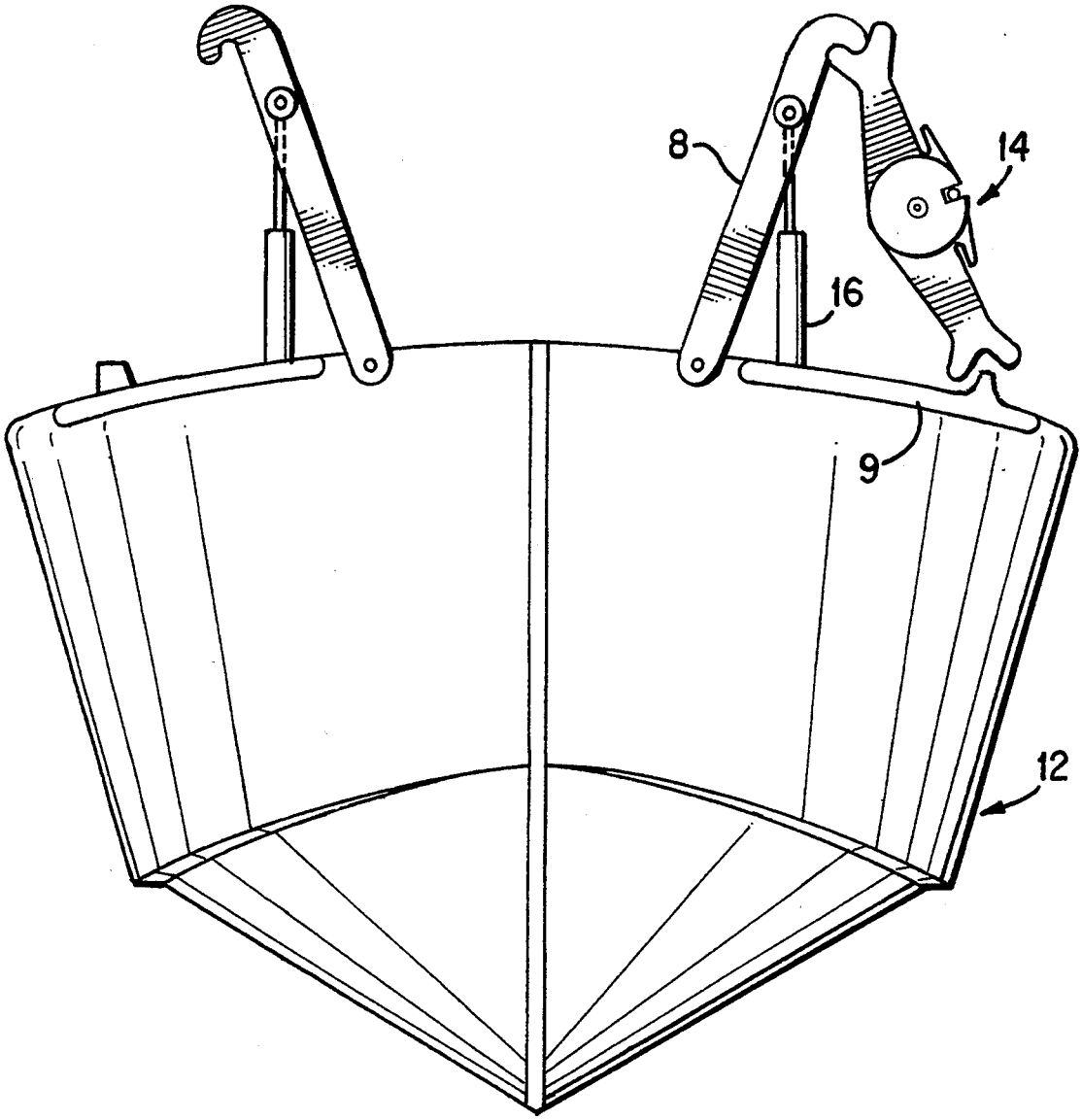
FIG. 1 is a front plan view of a typical boat hull and deck having a hatch assembly in the opened position.

FIG. 1 shows a plan view of a typical boat 12 which would utilize the teachings of the present invention. As shown, a hatch 8 is propped into its opened position utilizing the present invention 14. Once it commences to rain, a soluble restraining member which is subjected to the rain either directly or indirectly will either partly or completely dissolve, thereby allowing the present invention 14 to collapse, thereby assisting in the closure of the hatch 8.

Figure 2:
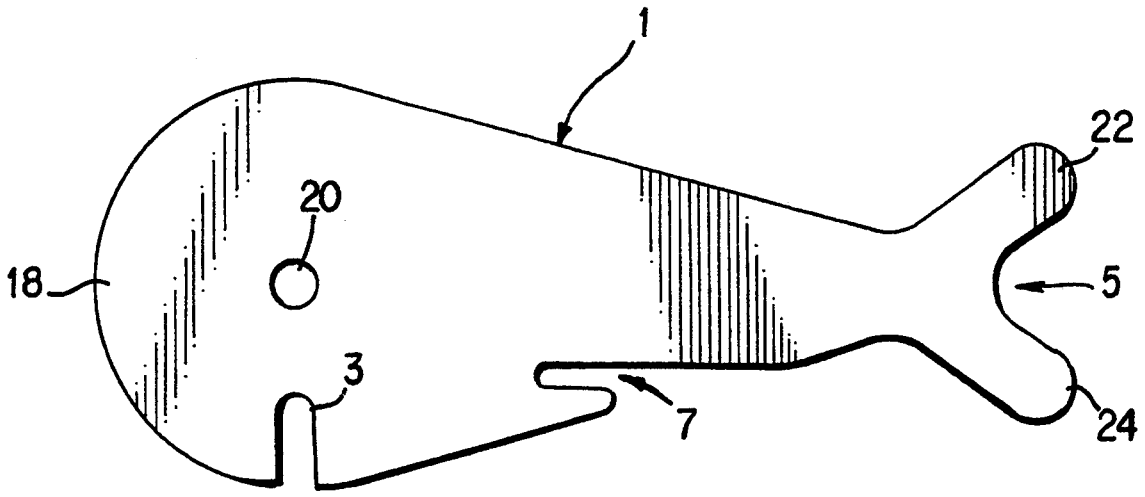
FIG. 2 is a top view of one of the arms of the present invention.
Figure 3:
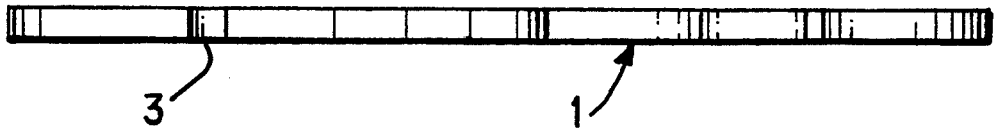
FIG. 3 is a side view of the arm shown in FIG. 2.

FIGS. 2 and 3 show one of the arms which is utilized in the present invention. It is noted that the present invention utilizes two of these arms as a strut to maintain the hatch in an opened position when it is not raining. When it begins to rain, the strut would act as a closure element which assists in the closure of an opened hatch. Therefore, although both of these arms could have the same form or shape in construction, it is not crucial that these arms be duplicates of one another. A typical arm 1 is provided with a rounded top portion 18 which includes a hole 20 therethrough. A slot 3 is also provided at this end 18 for receiving a soluble restraining element 4 therein (see FIG. 4). Longitudinally opposite from the end 18 is a second extremity 5 provided with arms 22, 24 used to form a recess therebetween. Approximately halfway between the ends 5 and 18 is a hook 7 used to receive a tension member, such as a spring or a rubber band.

Figure 4:
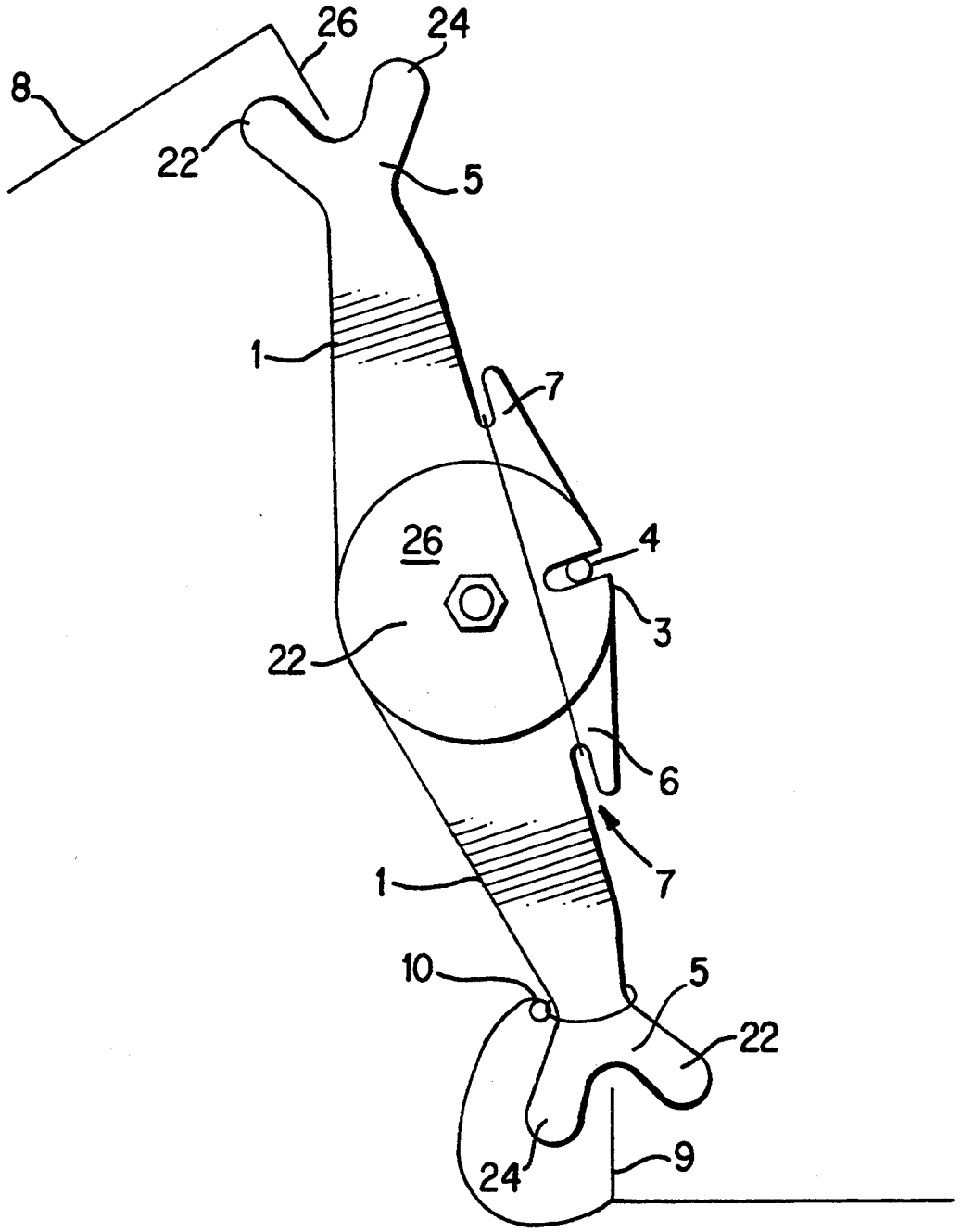
FIG. 4 is an elevational view of the present invention in the arms, opened position.

FIG. 4 illustrates the present invention when it is in the armed position thereby allowing the hatch 8 to remain open. The arms 1 are free to rotate on a pivot 22 provided within hole 20, until the slots 3 are in alignment. At this point, the soluble restraining element 4, such as uncoated aspirin is inserted into the slots to prevent additional rotation of the arms 1. Additionally, the arm extremities 5 of each of the arms 1 and the pivot 22 are in alignment, thus preventing longitudinal forces applied to the extremities 5 from transmitting shearing forces to the aspirin 4. In this position, an edge 26 of the hatch 8 is secured into a recess formed between the arms 22, 24 of one of the arm extremities 5, and one of the arms 24 is placed within a recess of the hatch frame 9 of the boat. A rubber band 6 is attached to the hooks 7 on the arms 1, providing a constant shearing force on the soluble restraining element 4 and preventing it from dislodging. Each of the arms 1 is provided with a flat surface in the vicinity of the soluble restraining element 4 to provide capillary action to moisture, thereby aiding in the mechanical conduction of the moisture to the soluble restraining element 4, thereby increasing the target area for drops of rain over and above the actual target area provided by the soluble restraining 4. A string or other securing device 10 is applied to one of the arms 1 close to its extremity. This string is adapted to be tied around a portion of the hatch frame 9 to retain the strut after it collapses to ensure that the strut does not fall far from the hatch, thereby preventing any injury or damage.

In use, the existing hatch support mechanism 16 can be disabled and the present invention 14 is then used to support the hatch with the soluble restraining element directed outward from the boat. Alternatively, the present invention can be used in addition to the hatch support mechanism 16. In addition to direct hits, drops of rain landing on the central hinge portion 26 are conducted by capillary action until they are absorbed by the soluble restraining element and, within a few seconds, this element would soften, thereby allowing the rubber band 6 to trip the pivot 22 out of alignment with its ends, thereby precipitating the collapse of the strut 14. Once the strut collapses, the hatch will close due to the force of gravity.

It should be noted that as indicated hereinabove, uncoated aspirin can be used as the soluble restraining element. Coated aspirin, if employed, may be scraped to remove its coating before it is inserted into the slot 3. Other water absorbing substances could be utilized for the soluble restraining element if they have adequate properties of strength when dry, weakness when wet and appropriate affinity for water. If desired, the degree of coating on the aspirin can be employed as a time delay to alter the response of the hatch closure.

While the invention has been described in conjunction with a preferred embodiment, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. An assembly used to automatically close a hatch from an open position to a pivoted closed position against a frame, when it begins to rain; comprising:

first and second arm members pivotally connected to one another, said first arm member provided with a first extremity portion for supporting the hatch in the opened position and a first hinge portion opposite said extremity portion, said first hinge portion provided with a first slot, said second arm member provided with a second extremity portion supported by the frame and a second hinge portion opposite said extremity portion, said second hinge portion provided with a second slot;

a pivot pin connected to the hinge portion of said first arm member and the hinge portion of said second arm member which would allow said first and second arm members to freely rotate, allowing said first and second slots to align, as well as said first and second extremity portions to form a straight line with said slots;

a soluble restraining element inserted into said first and second slots when said first and second slots are aligned;

a tension member connected between said first and second arm members to provide a force on said soluble restraining element;

wherein when said soluble restraining element becomes wet and softens, said tension member forces said arms to pivot, thereby moving said first and second extremity portions out of line such that said first extremity portion no longer supports the hatch, allowing the hatch to close by the force of gravity.

2. An assembly used to automatically close a window from an open position to a pivoted closed position against a frame, when it begins to rain; comprising:

first and second arm members pivotally connected to one another, said first arm member provided with a first extremity portion for supporting the window in the opened position and a first hinge portion opposite said extremity portion, said first hinge portion provided with a first slot, said second arm member provided with a second extremity portion supported by the frame and a second hinge portion opposite said extremity portion, said second hinge portion provided with a second slot;

a pivot pin connected to the hinge portion of said first arm member and the hinge portion of said second arm member which would allow said first and second arm members to freely rotate allowing said first and second slots to align, as well as said first and second extremity portions to form a straight line with said slots;

a soluble restraining element inserted into said first and second slots when said first and second slots are aligned;

a tension member connected between said first and second arm members to provide a force on said soluble restraining element;

wherein when said soluble restraining element becomes wet and softens, said tension member forces said arms to pivot, thereby moving said first and second extremity portions out of line such that said first extremity portion no longer supports the window, allowing the window to close by the force of gravity.

3. The assembly in accordance with claim 1, wherein said soluble restraining element is aspirin.

4. The assembly in accordance with claim 2, wherein said soluble restraining element is aspirin.

5. The assembly in accordance with claim 3, wherein said aspirin is coated.

6. The assembly in accordance with claim 4, wherein said aspirin is coated.

7. The assembly in accordance with claim 3, wherein said aspirin is uncoated.

8. The assembly in accordance with claim 4, wherein said aspirin is uncoated.

9. The assembly in accordance with claim 1, further including a string affixed between the frame and said second extremity.

10. The assembly in accordance with claim 2, further including a string affixed between the frame and said second extremity.

11. The assembly in accordance with claim 1, wherein both of said first and second arms are provided with a hook for connecting said tension member therebetween.

12. The assembly in accordance with claim 2, wherein both of said first and second arms are provided with a hook for connecting said tension member therebetween.

13. The assembly in accordance with claim 1, wherein said tension member is a rubber band.

14. The assembly in accordance with claim 2, wherein said tension member is a rubber band.

15. The assembly in accordance with claim 1, wherein said first and second hinge portions are flat, allowing moisture to be directed to said soluble restraining element by capillary action.

16. The assembly in accordance with claim 2, wherein said first and second hinge portions are flat, allowing moisture to be directed to said soluble restraining element by capillary action.

* * * * *